United States Patent [19]

Alvin

[11] 4,250,589

[45] Feb. 17, 1981

[54] ROAD SWEEPING BROOM

[76] Inventor: Pierre Alvin, 2 av. du Mont Saint Jean Antibes, Antibes, France, 06600

[21] Appl. No.: 21,884

[22] Filed: Mar. 19, 1979

[30] Foreign Application Priority Data

Mar. 21, 1978 [FR] France ..... 78 08193

[51] Int. Cl.[3] ..... A46B 3/02

[52] U.S. Cl. ..... 15/193

[58] Field of Search ..... 15/159 R, 159 A, 168, 15/170, 193

[56] References Cited

U.S. PATENT DOCUMENTS

| | | | |
|---|---|---|---|
| 246,500 | 8/1881 | Hall | 15/159 R X |
| 2,070,448 | 2/1937 | Nork | 15/168 |
| 2,508,799 | 5/1950 | Reis, Jr. | 15/159 A |
| 3,047,898 | 8/1962 | Levite | 15/159 A |
| 3,072,944 | 1/1963 | Clayton et al. | 15/159 A |
| 3,186,019 | 6/1965 | Hattori | 15/159 A X |
| 3,609,792 | 10/1971 | Wiese | 15/193 |

*Primary Examiner*—Christopher K. Moore

*Attorney, Agent, or Firm*—Weingarten, Maxham & Schurgin

[57] ABSTRACT

The present invention relates to a road sweeping broom constituted by a handle and a bundle of fibres fixed at one of its ends; according to the invention, the fibres of the bundle are constituted partly by synthetic fibres and partly by vegetable fibres. These fibres are bound together at one of the ends of the bundle and at least in one other zone distinct from said end. The invention finds particular application in the domain of highway equipment.

6 Claims, 3 Drawing Figures

ROAD SWEEPING BROOM

The present invention relates to a broom of the type such as those used in particular by municipal workers for manually sweeping the public highway.

To carry out this type of operation, it is known to use brooms, at the end of the handle of which a bundle of birch or brushwood twigs is bound by their end of largest section. The assembly thus constituted presents several advantages, namely a high sweeping power for a low weight and a progressive flexibility increasing from the handle to the sweeping end. However, these known brooms wear out very quickly and it is more difficult to find manufacturers thereof.

It is an object of the invention to provide a broom replacing those heretofore used, which has the same advantages of lightness, ease of handling and sweeping power, whilst offering a much greater resistance to wear and tear, thus a longer life.

To this end, the invention relates to a broom constituted by a handle provided at one of its ends with a bundle of fibres.

According to one of the features of the invention, the fibres of the said bundle are constituted partly by synthetic fibres and partly by vegetable fibres preferably homogeneously bound together at one of the ends of the bundle and at least in one other zone distinct from said end.

The connection of said other zone is preferably effected by means of a polymerisable synthetic material coating all the fibres; its section being non-circular.

The invention will be more readily understood on reading the following description with reference to the accompanying drawings, in which.

Figure 1:
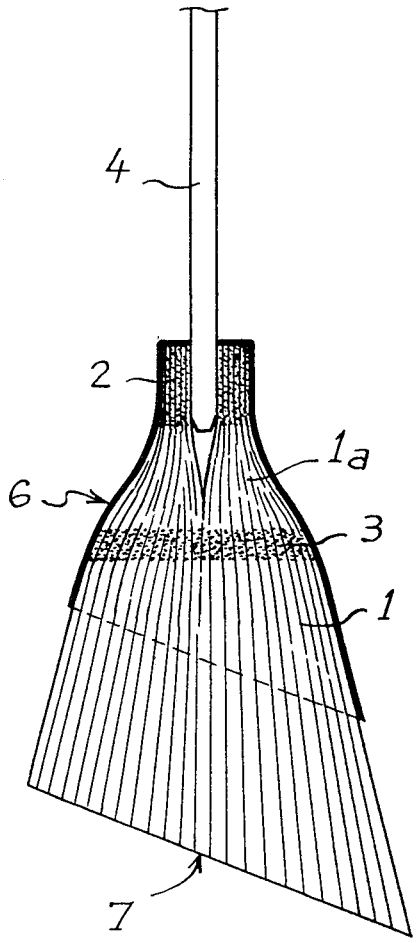
FIG. 1 shows in section an embodiment of a broom according to the invention.
Figure 3:
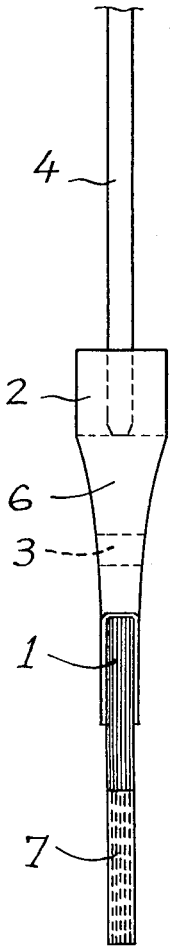
FIG. 3 is a side view of FIG. 1.

Referring now to the drawings, it is seen that the broom according to the invention is constituted by a bundle 1 of fibres preferably homogeneously bound together at one of their ends 2 and in a zone 3 distinct from this end. The bundle of fibres comprises on the one hand fibres of synthetic plastics material of the polyvinyl chloride, polypropylene, polyamide type and, on the other hand, vegetable fibres of the rice straw, piassava-scherbro, or calabar, palmyrah type, well known in the domain of sweeping. By way of example, the proportion by weight of these fibres is about three eighths for the synthetic fibres which have a diameter of the order of 1.5 to 2.5 mm and of five eighths for the vegetable fibres. Thus, a bundle of fibres is obtained which has a good resistance to wear and tear conferred by the synthetic fibres, whilst having a good sweeping power conferred by the vegetable fibres which are packed tight between the hard fibres.

The connection of the fibres in the end zone 2 may be constituted by a clamp for fastening said fibres around the end of a handle 4. This connection will preferably be effected by injection at this level, in a suitable mould having received said fibres, of a polymerizable resin by which said fibres will be coated and embedded. Either a metal insert in the form of a socket or a core for making a hole for fitting the handle will have been provided at the spot where the handle is fixed.

Figure 2:
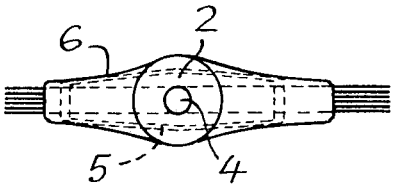
FIG. 2 is a plan view of FIG. 1.

The connection in the zone 3 is also effected by the injection of resin between the fibres so as to coat them completely. The section shown at 5 in FIG. 2 of this zone of connection takes an elongated form which enables the fibres to be maintained in an arrangement of small thickness and large width so as to present a wide sweeping front. It is therefore seen that the fibres are anchored between two zones 2 and 3. The portion 1*a* of the bundle, included between these zones, is of limited flexibility, less than the flexibility of the fibres at their free end. The stiffness of this portion 1*a* will depend on the distance separating said zones.

In addition, it will be noted that zones 2, 1*a* and 3, as well as a portion located beneath zone 3 of the bundle are surrounded by a skirt 6 formed of resin reinforced with mineral fibres (in the form of a fabric or mat) which embellishes the broom.

Finally, the free end of the bundle of fibres is cut in a plane 7 not perpendicular to the axis of the handle 4, in order to take into account the inclined position of the broom when in use.

The advantages of the broom according to the invention reside in its lightness and very low cost price taking into account its long life with respect to birch or brushwood brooms. In addition, the materials used may be rendered at least partly fire-proof, this considerably reducing the fire risks that the collective or municipal stores of road-sweeping brooms run.

The invention finds advantageous application in the domain of highway equipment.

What is claimed is:

1. In a broom comprising a handle and a bundle of fibres bound together at one end and attached to one end of the handle, an improvement comprising means for connecting together said bundle of fibres in at least one other zone distinct from said end binding, said connecting means being a polymerizable synthetic material coating all of the fibres in said bundle and adhering them together, said bundle of fibres comprising a mixture of synthetic fibres and vegetable fibres.

2. The broom of claim 1, wherein the end binding is effected by means of a polymerizable synthetic resin in which the corresponding end of said fibres is embedded.

3. The broom of claim 1 wherein the connection of said other zone is of non-circular section.

4. The broom of claim 1, wherein the free end of the fibres of the bundle is cut in a plane not perpendicular to the axis of the handle.

5. The broom of claim 1, wherein the bundle of fibres is partly covered by a skirt of polymerizable resin reinforced by mineral fibres extending from its end where it is fixed to the handle to beyond the connection of said other zone.

6. The broom of claim 1 wherein said synthetic fibres and vegetable fibres are homogeneously mixed to comprise said bundle of fibres.

* * * * *